US005507541A

United States Patent [19]

Chen et al.

[11] Patent Number: 5,507,541

[45] Date of Patent: Apr. 16, 1996

[54] BALL RETRIEVAL CART

[76] Inventors: Sam H.-S. Chen, 13947 Carriage Rd.; Shunder Chang, 12320 Stowe Dr., #J, both of Poway, Calif. 92064; East White, No. 14 San-Si St., Taichung, Taiwan

[21] Appl. No.: 237,865

[22] Filed: May 4, 1994

[51] Int. Cl.[6] ..... A63B 47/02; B62B 3/02

[52] U.S. Cl. ..... 294/19.2; 280/47.371

[58] Field of Search ..... 294/19.2; 414/439, 414/440; 248/129, 132; 280/47.315, 47.34, 47.36, 47.371, 651, 655, 655.1, 659, DIG. 3

[56] References Cited

U.S. PATENT DOCUMENTS

| | | | |
|---|---|---|---|
| 2,415,392 | 2/1947 | Morehouse | 280/655 X |
| 2,903,082 | 9/1959 | Marcus | 280/47.371 X |
| 3,371,950 | 3/1968 | Stap | 294/15 |
| 4,184,707 | 1/1980 | Nelson et al. | 294/19 A |
| 4,461,504 | 7/1984 | Perez et al. | 294/19 A |
| 4,527,813 | 7/1985 | Kaufman | 280/47.315 X |
| 4,844,527 | 7/1989 | Ray | 294/19.2 |
| 4,957,319 | 9/1990 | Bontempo | 294/19.2 |
| 5,137,315 | 8/1992 | Bontempo | 294/19.2 |
| 5,301,991 | 4/1994 | Chen et al. | 294/19.2 |

*Primary Examiner*—Dean Kramer
*Attorney, Agent, or Firm*—Calif Tervo

[57] ABSTRACT

A ball retrieval cart generally comprising a wheeled container for retrieving and storing balls and a pair of handles attached thereto. The container is rollingly supported by wheels on an axle. The container has a bottom including rails defining ball retrieval slots through which balls on the ground pass into the container when the rails are lowered over the balls. The handles, a front handle and a rear handle, are pivotally attached to the cart. A connector can be used to attach the handles together such that the position of the rear handle relative to the container can be adjustably fixed as desired by a user such that user can pivot the cart about the axle to raise and lower the bottom for retrieving balls. The handles are rotatable, also, to a substantially vertical support position supporting the cart in a ball dispensing position. The handles are rotatable, also, to above the cart such that they may be jointly gripped by a user as a carrying handle.

3 Claims, 3 Drawing Sheets

BALL RETRIEVAL CART

BACKGROUND OF THE INVENTION

This invention relates in general to ball retrieval carts and more specifically to a cart of the type that must be rotated to gather balls through the very bottom of the cart.

SUMMARY OF THE INVENTION

The invention is a ball retrieval cart generally comprising a wheeled container for retrieving and storing balls and a pair of handles attached thereto. The container is rollingly supported by wheels on an axle.

The container has a bottom including rails defining ball retrieval slots through which balls on the ground pass into the container when the rails are lowered over the balls.

The handles, a front handle and a rear handle, are pivotally attached to the cart. A connector can be used to attach the handles together such that the position of the rear handle relative to the container can be adjustably fixed as desired by a user such that user can pivot the cart about the axle to raise and lower the bottom for retrieving balls.

The handles are rotatable, also, to a substantially vertical support position supporting the cart in a ball dispensing position.

The handles are rotatable, also, to be disposed above the cart such that they may be jointly gripped by a user as a carrying handle.

Other features and many attendant advantages of the invention will become more apparent upon a reading of the following detailed description together with the drawings in which like reference numerals refer to like parts throughout.

DETAILED DESCRIPTION OF THE INVENTION

Figure 1:
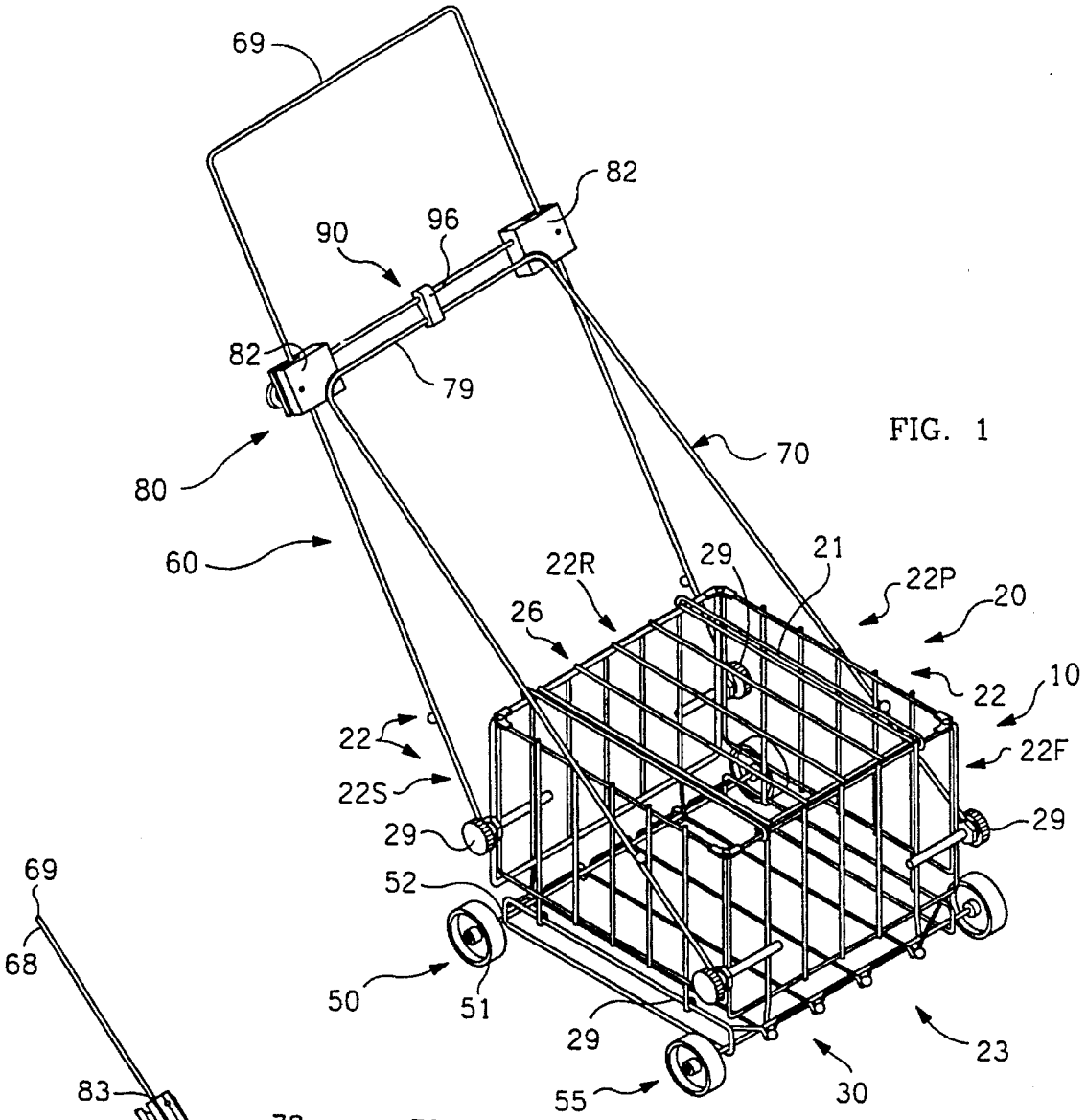
FIG. 1 is a perspective view of a preferred embodiment of the ball retriever cart of the invention with the handles in the ball retrieval position.

With reference now to the drawings, and more particularly to FIG. 1 thereof, there is shown a perspective view of a preferred embodiment of the ball retrieval cart, designated generally as 10, shown in the ball retrieval mode. A container, designated generally as 20, for retaining balls in the interior, is made of any suitable material, such as metal grating. For purposes of description, container 20 has a front end, denoted generally as 23, a rear end, denoted generally as 26, a bottom, denoted generally as 30, a top, denoted generally as 21, and walls 22, including left wall 22P, right wall 22S, front wall 22F, and rear wall 22R.

Figure 2:
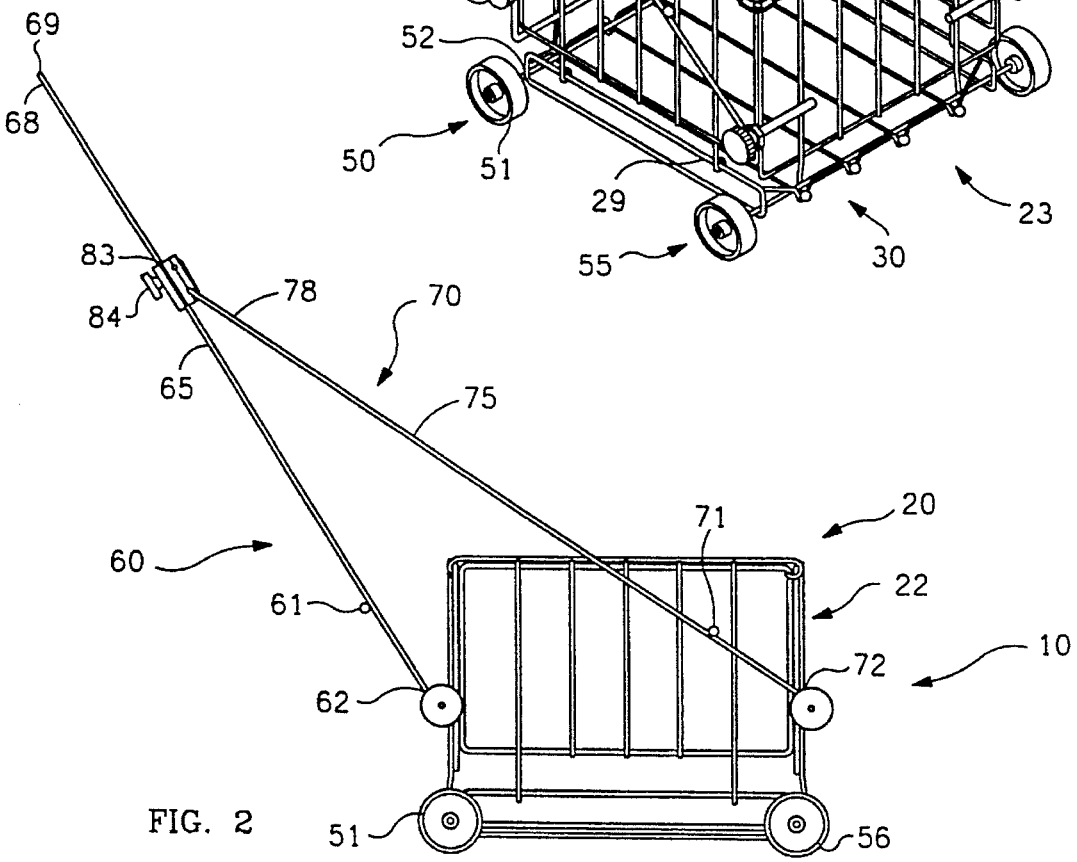
FIG. 2 is a side elevation view of the cart of FIG. 1.
Figure 3:
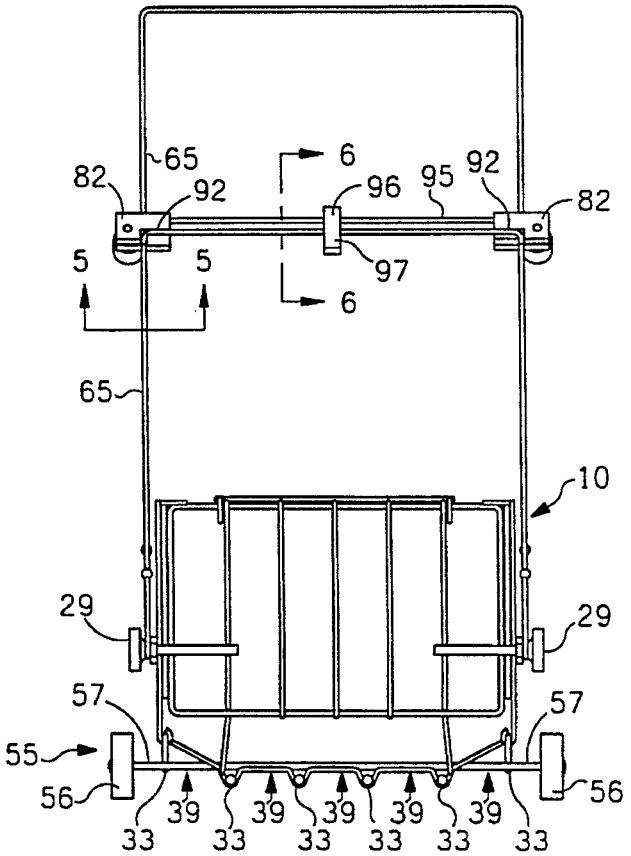
FIG. 3 is a front elevation view of the cart of FIG. 1.
Figure 4:
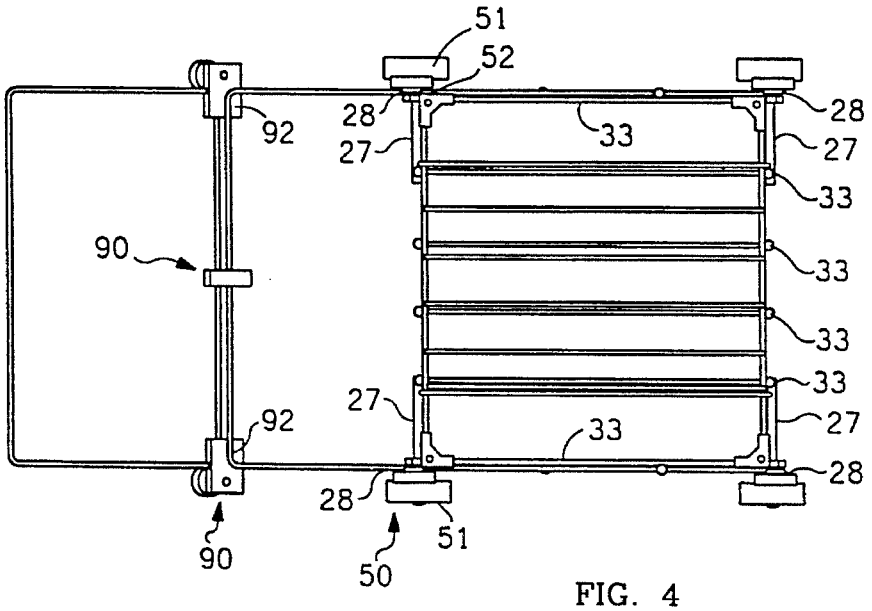
FIG. 4 is a top plan view of the cart of FIG. 1.

Looking further at FIGS. 2–4; FIG. 2 is a side elevation view of cart 10 FIG. 1. FIG. 3 is a front elevation view of cart 10 of FIG. 1. FIG. 4 is a top plan view of cart 10 of FIG. 1. As best seen in FIGS. 3 and 4, bottom 30 includes rails, denoted generally as 33, defining ball retrieval slots 39 through which balls pass to enter container 20 when rails 33 are lowered over a ball on the ground. In its broadest sense, bottom 30 may be of any suitable configuration of the type wherein balls enter container 20 through slots in the bottom when container 20 is lowered over a ball on the ground. In the embodiment shown, six rails 33 between front end 23 and rear end 26 define five ball retrieval slots 39. Examples of suitable bottom configurations and their workings are shown and described in U.S. Pat. No. 3,371,950 of STRAP, U.S. Pat. No. 4,184,707 of NELSON ET AL, U.S. Pat. No. 4,461,504 of PEREZ ET AL and U.S. Pat. No. 5,301,991 of CHEN ET AL; the teachings of which are incorporated herein by reference.

Wheel means including axle means, such as rear wheel and axle assembly 50 attached near rear end 26 and front wheel and axle assembly 55 attached near front end 23 of container 20, rollingly support container 20 such that balls may be retrieved. To accomplish this, wheel assemblies 50, 55 must allow bottom 30 to get close enough to the ground to retrieve balls and be positioned such that cart 10 can be manipulated to place bottom 30 over balls on the ground. Rear wheel and axle assembly 50 includes a pair of rear wheels 51 connected to container 20 by co-axial axles 52. As best seen in FIG. 3, Front wheel assembly 55 includes a pair of front wheels 56 connected to container 20 by co-axial axles 57.

A pair of handles, including a first or rear handle, denoted generally as 60 and a second or front handle, denoted generally as 70, are pivotally attached to cart 10. Rear handle 60 has a proximal end 62 pivotally attached to cart 10 at or near rear end 26, an extended portion 65 and distal end 68 including a gripping portion 69 for gripping by a user. In the preferred embodiment, rear handle 60 is a U-shaped rod, such as of strong metal, having proximal ends 62 pivotally attached to cart 10 such that the pivot planes of extended portions 65 lie outside of each side 22P, 22S.

Front handle 70 has a proximal end 72 pivotally attached to cart 10 at or near front end 23, an extended portion 75 and distal end 78 including a gripping portion 79 for gripping by a user. In the preferred embodiment, front handle 70 is identical to rear handle 60 and is a U-shaped rod, such as of strong metal, having proximal ends 62 pivotally attached to container 20 such that the pivot planes of extended portions 75 lie outside of each side 22P, 22S.

Handles 60,70 are pivotally attached to cart 10. Preferably, also, the attachment includes means for releasingly attaching handles 60,70 and means for locking handles 60,70 in a given position. This may be done in several manners. In the preferred embodiment shown, cart 10 includes four anchors 27, such as of metal rod, each having a protruding pin 28. Proximal handle ends 62, 72 each terminate in a loop that fits over its own pin 28 and about which it pivots. The end portion of each pin 28 is threaded and a locking knob 29 threadably attached to pin 28 can be turned to clamp the attached handle in a given position against anchor 27. An alternate configuration, not shown, provides for each anchor to have a threaded bore and for each knob to include a threaded shaft for threaded engagement with the anchor bore and about which the handle loop is disposed. Knobs 29 aid in holding handles 60,70 in attached condition and removing knobs 29 allows handles 60,70 to be easily removed from cart 10 to make a more compact arrangement for purposes of storage or transport.

A connector assembly, denoted generally as 80, is adjustably slidingly clampable to extended portions 65 of rear handle 60 and releasably attachable to distal ends 78 of front handle 70 such that the position of rear handle 60 (and front handle 70) relative to container 30 can be adjustably fixed as desired by a user. Thus, the user can adjust the height of the rear handle gripping portion 69 to a position that allows the user to most easily pivot cart 10 about an axle 52,57 to raise and lower either the front 23 or rear 26 of cart 10 to place bottom 30 over balls for retrieving.

As best seen in FIGS. 2–6, connector assembly 80 is generally comprised of two slidable clamps 82 and attachment means, such as latch assembly 90, for attaching front handle 70 to clamps 82.

Figure 5:
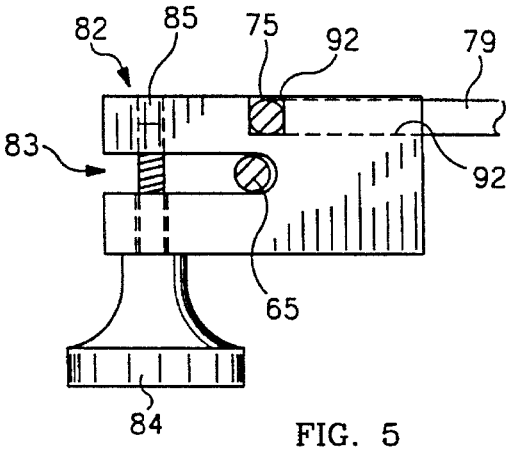
FIG. 5 is an enlarged view of the handle connector taken on line 5—5 of FIG. 3.

FIG. 5 is a enlarged view of clamp 82 taken on line 5—5 of FIG. 3. Clamp 82 includes a channel 83 of width to snugly accommodate handle extended portion 65 which is disposed in the channel bottom. Clamp 82 may be slid along handle 60. Means for adjusting the width of channel 83, such as bolt 84 and bore 85, is provided to reduce the width of channel 83 thereby clamping clamp 82 on handle 60 at a desired location.

Figure 6:
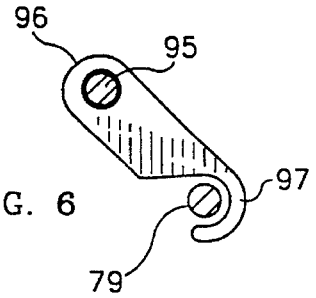
FIG. 6 is an enlarged view of the handle connector clip taken on line 6—6 of FIG. 3

Latch assembly 90 includes a receiving channel 92 in clamp 82 for receiving front handle 70 and for bearing against distal end 79 such that further forward rotation of rear handle 60 is prevented. Means, such as rod 95 and clip 96, connected to clamps 82 prevent further rearward rotation of rear handle 60 by attaching to front handle 70, such as to grip 79. Rod 95 is connected between clamps 82 and clip 96 pivots on rod 85. FIG. 6 is an enlarged view of handle connector clip 96 taken on line 6—6 of FIG. 3. Clip 96 has a free end 97 that latches over grip portion 79 and prevents withdrawal of front handle 70. The resiliency necessary to accomplish this latching function may come from resiliency of clip 95 or may come from the resiliency of squeezing rod 95 and grip 79 together or a combination. Clip 96 may be of resilient material, such as of strong resilient plastic. In this manner, rear handle 60 is prevented from rotational movement relative to cart 10. A user can easily rotate cart 10 about an axle by pushing up or down on grip 69.

Figure 7:
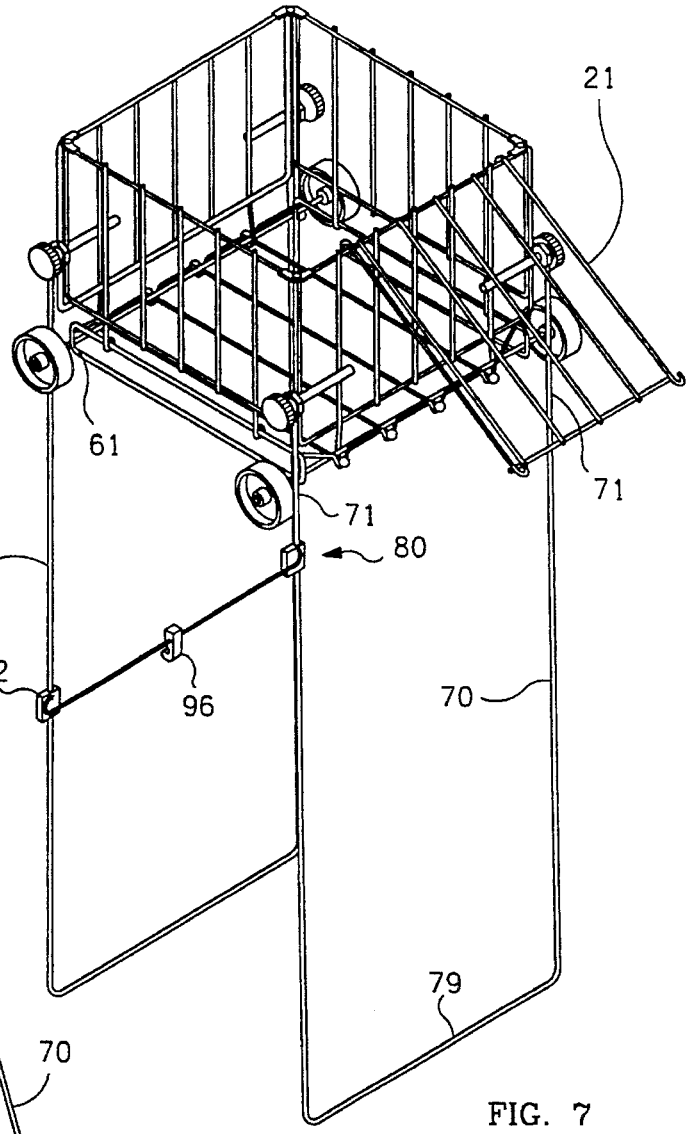
FIG. 7 is a perspective view of the cart of FIG. 1 with the handles in the ball dispensing position.

FIG. 7 is a perspective view of the cart of FIG. 1 with the handles in the ball dispensing position. Top 21 is hingedly connected to the top of an end wall, such as to front wall 22F such that it may be swung out of the way in the ball-dispensing position of FIG. 7. Handles 60,70 may be rotated to a substantially vertical support position supporting cart 10 in a ball dispensing position. Each handle extended portion 65,75 includes detents, bulges 61,71, which engage under a portion of cart 10, such as under axles 52,57, to hold handles 60, 70 in the dispensing position. Locking knobs 29 can also be tightened if necessary to add to stability in the dispensing position.

Figure 8:
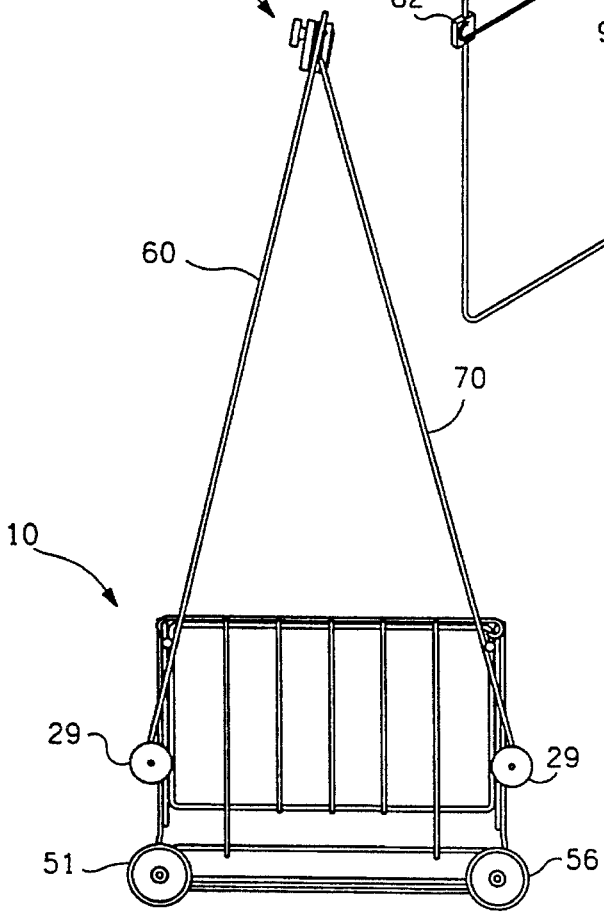
FIG. 8 is a reduced side view of the cart of FIG. 1 with the handles in the carrying position.

FIG. 8 is a reduced side view of the cart of FIG. 1 with handles 60,70 rotated such that distal ends 68,78 are disposed above cart 10 such that they may be jointly gripped by a user as a carrying handle.

Having described the invention, it can be seen that it provides a very convenient device for retrieving tennis balls.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. In combination:

a ball retrieval cart comprising:

a container for retrieving and storing balls; said container having a front end and a rear end and having a bottom including rails defining ball retrieval slots through which balls on the ground pass into said container when said rails are lowered over the balls; and wheel means including axle means attached to said container for rollingly supporting said container such that balls may be retrieved; and a pair of handles including:

a first handle having:

a proximal end pivotally attached to said cart at or near said rear end;

an extended portion; and a distal end;

a second handle having:

a proximal end pivotally attached to said cart apart from said first handle proximal end;

an extended portion; and a distal end; and a connector slidably attached to said first handle extended portion; said connector including:

a clamp for selectively fixing the position of said connector on said first handle extended portion; and a latch releasably attachable to said distal end of said second handle such that the position of said first handle relative to said container can be adjustably fixed as desired by a user such that user can manipulate said first handle to pivot said cart about said axle means to raise and lower said bottom for retrieving balls; said handles, when said second handle is detached from said connector, being rotatable to a support position forming legs supporting said cart in a ball dispensing position; said handles being rotatable such that said distal ends are disposed above said cart and may be jointly gripped by a user as a carrying handle.

2. The combination of claim 1 wherein:

said first handle distal end includes a gripping portion for gripping by a user.

3. The combination of claim 1 wherein:

said connector, when attached to said second handle, is slidable to near said first handle distal end such that said distal ends of said handles are disposed above said cart and may be jointly gripped by a user as a carrying handle.

* * * * *